United States Patent [19]

Newcomb

[11] Patent Number: 5,016,021

[45] Date of Patent: May 14, 1991

[54] 12 AND 17 METER ADAPTER ASSEMBLIES

[75] Inventor: Donald R. Newcomb, Lockhart, Tex.

[73] Assignee: Butternut Electronics Company, Lockhart, Tex.

[21] Appl. No.: 465,446

[22] Filed: Jan. 16, 1990

[51] Int. Cl.[5] ..... H01Q 9/14; H01Q 9/18

[52] U.S. Cl. ..... 343/722; 343/749; 343/750

[58] Field of Search ..... 343/722, 749, 752, 750

[56] References Cited

U.S. PATENT DOCUMENTS 3,737,907 6/1973 Monola ..... 343/752

4,207,574 6/1980 Toia ..... 343/752

*Primary Examiner*—Michael C. Wimer

*Attorney, Agent, or Firm*—Hugh D. Jaeger

[57] ABSTRACT

12 and 17 meter adapter assemblies for a vertical antenna which includes an air wound inductance coil and winged capacitor straps. The adapter assemblies include a coil and wing capacitor straps at one end of the coil where the one end of each coil connects to the antenna and the other end of each coil, including the wing capacitor straps, mechanically connects to the antenna and is electrically insulated from the antenna.

2 Claims, 3 Drawing Sheets

12 AND 17 METER ADAPTER ASSEMBLIES

BACKGROUND OF THE INVENTION

1. Field of the Invention

The present invention pertains to an assembly for a vertical antenna, and more particularly, pertains to a 12 and 17 meter adapter assemblies for a vertical antenna, such as a ten band vertical antennas or for a beam antenna.

2. Description of the Prior Art

Prior art antennas, especially vertical antennas, utilized strapped coils which have been inefficient and nonpractical.

The assignee of the present invention has designed a series of antennas which utilize air inductance coils and capacitor assemblies which enhance radiation with negligible (zero) losses.

The prior art antennas have utilized various assemblies to resonate vertical antennas on various frequencies which has caused loss in the antennas, and have been ineffective in radiation.

The present invention overcomes the disadvantages of the prior art by providing an air inductance-capacitive adapter assembly which resonates an antenna, such as a vertical antenna or beam antenna, on predetermined frequencies with negligible (zero) loss.

SUMMARY OF THE INVENTION

The general purpose of the present invention is to provide an adapter assembly for a vertical antenna or a beam antenna which causes the radiators below the assembly to resonate as a monopole.

According to one embodiment of the present invention, there is provided an add-on adapter assembly for a vertical antenna or beam antenna including a bracket for securing to the antenna, a coil of a predetermined number of turns, at least one capacitor wing strip connected to the coil, the end of the coil on the wing strip connected to an insulator, and the insulator connected to an element of either the vertical antenna or the beam antenna.

Significant aspects and features include a 12 and 17 meter adapter assemblies which can either be an add-on assembly or an original manufacture assemblies.

Other significant aspects and features of the present invention include an add-on adapter assembly for use at any predetermined frequency.

Having thus described the embodiments of the present invention, it is a principle object hereof to provide a 12 and 17 meter adapter assemblies for a vertical antenna, such as for a vertical antenna the subject matter of U.S. Pat. No. 4,442,436, assigned to the same assignee of this patent.

One object of the present invention is an assembly for a vertical antenna or a beam antenna.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
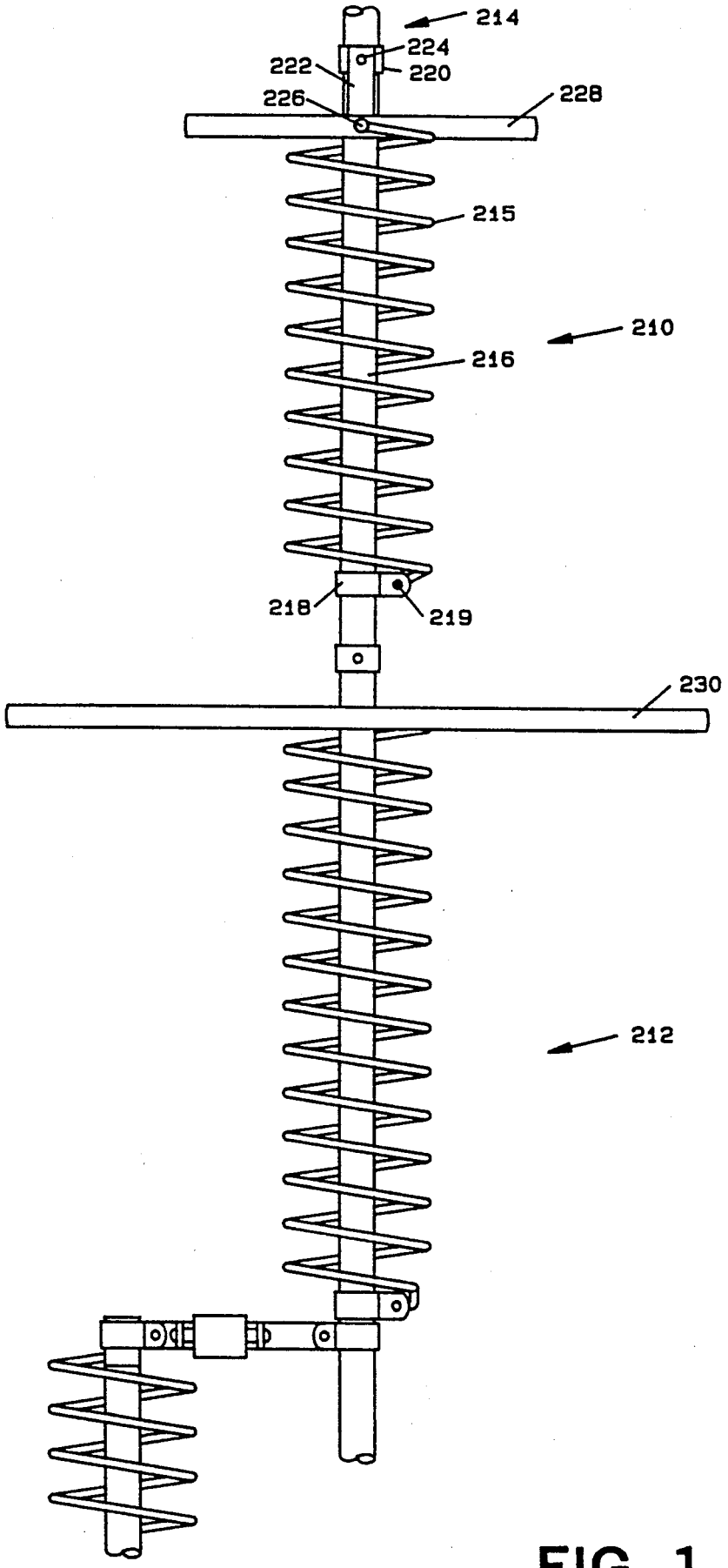
FIG. 1 illustrates a front view of an air wound inductance-capacitor antenna assembly.
Figure 3:
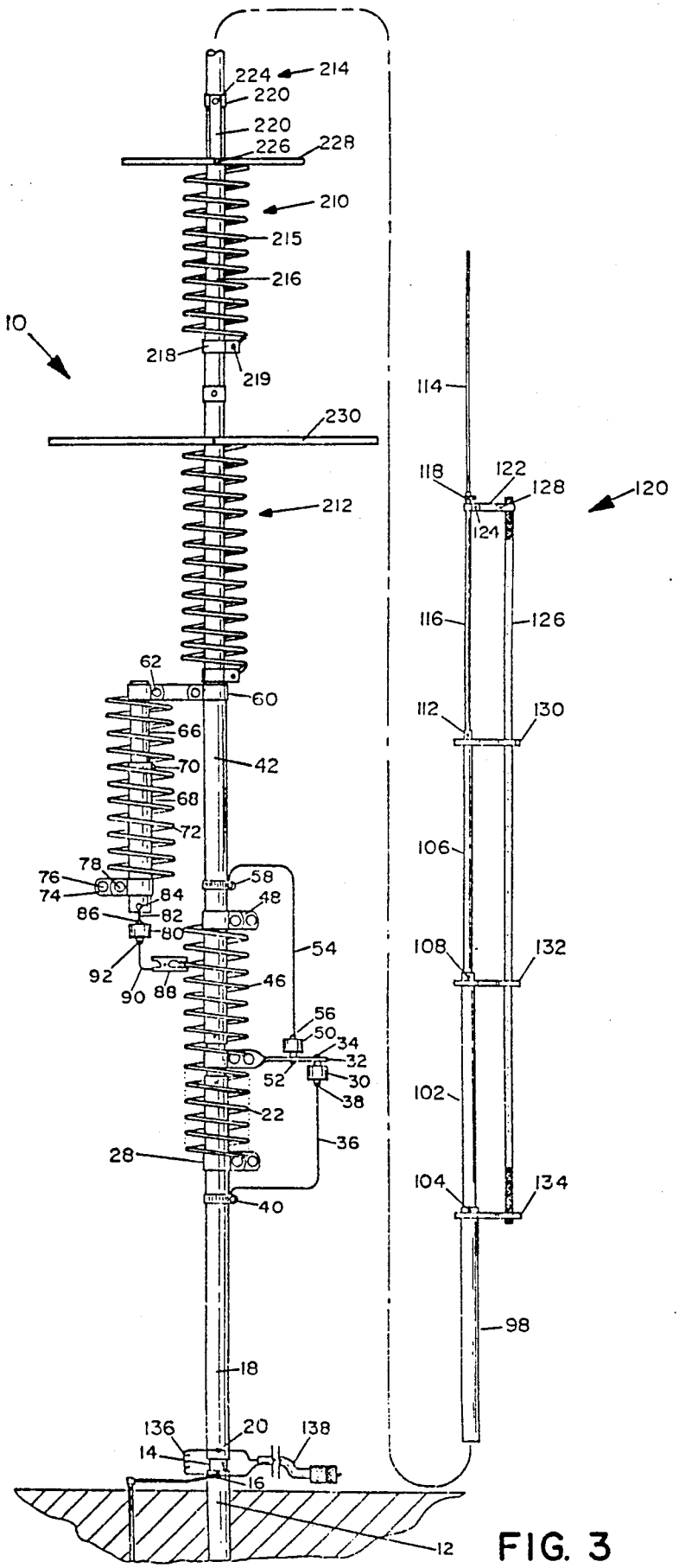
FIG. 3 illustrates a front view of two of the assemblies of a 12 and a 17 meter assembly for a vertical antenna, such as a 10-band vertical antenna, the subject matter of U.S. Pat. No. 4,442,436.

FIG. 1 illustrates a front view of a 12 meter adapter assembly 210 and a 17 meter adapter assembly 12 of FIG. 3 of the present invention for a multi-band vertical antenna 216, such as the subject matter of U.S. Pat. No. 4,442,436. The 12 meter adapter assembly 210 and the 17 meter adapter assembly 212 are similar in construction and attach to the vertical antenna 214 as illustrated in FIG. 3.

The 12 meter adapter assembly 210 is now described in detail. The air wound coil 215 of n turns is concentrically aligned over and about the vertical antenna member 216. A lower clamp 218 mechanically and electrically connects and secures between the bottom of air wound coil 215 and the vertical antenna member 216 with appropriate nut and bolt assemblies 19. An upper clamp 220 also connects and secures to the vertical antenna member 216 slightly above the top of 12 meter adapter assembly 210 with appropriate nut and bolt assemblies. A plastic insulator 222 secures to the upper clamp 220 with a nut and bolt assembly 224 and extends downwardly to meet the top of the 12 meter adapter assembly 210 where it secures thereto by a nut and bolt assembly 226. At least one horizontally aligned aluminum wing strip 228 secures electrically and physically to the top of the 12 meter adapter assembly 210 by the nut and bolt assembly 226 as illustrated in FIG. 2.

The 17 meter adapter assembly 212 is constructed and attached in the same manner, where the 17 meter adapter assembly 212 has more turns and the aluminum strip 230 is longer in length to effect antenna resonance at 17 meters.

Figure 2:
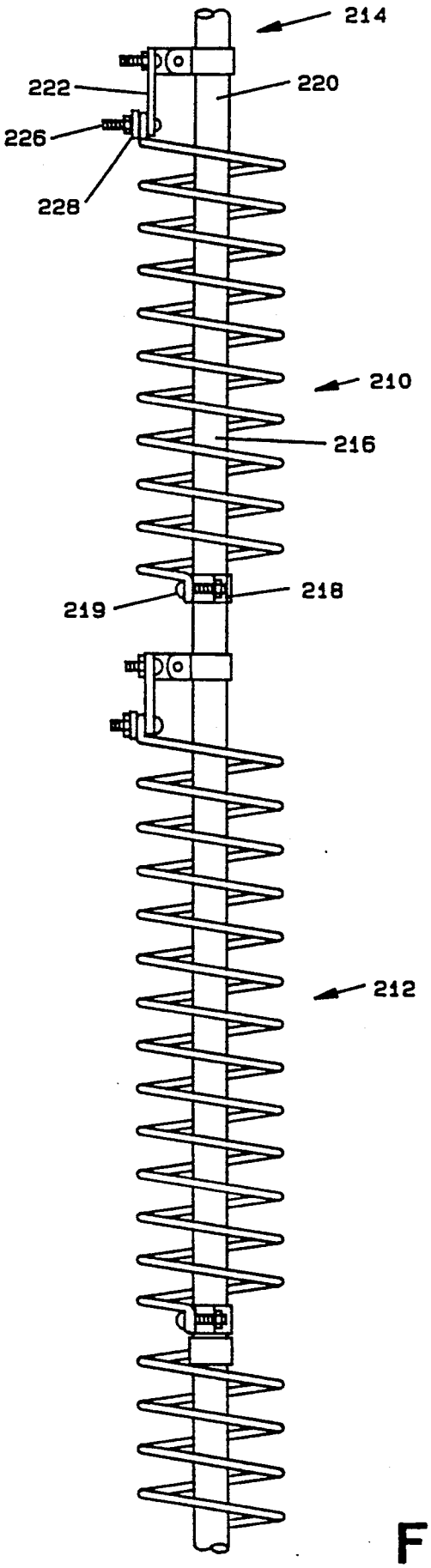
FIG. 2 illustrates a side view.

FIG. 2 illustrates a side view of a adapter assembly for an antenna where all numerals correspond to those elements previously described.

MODE OF OPERATION

FIG. 3 illustrates a plan view of a vertical antenna of U.S. Pat. No. 4,442,436 incorporated herein by reference with the 17 meter adapter assembly 212 and the 12 meter adapter assembly 210, wherein the description of FIG. 3 with reference numerals 10-138 can be found in the above patent.

The 17 and 12 meter assemblies consist of airwound inductance-capacitor inserted just above the upper end of the 30 meter coil of U.S. Pat. No. 4,442,436.

Attach the long aluminum strip to the bolt that fastens the 17 meter coil (the larger of the two units) to the plastic insulator between the coil and the upper clamp. Use a flat washer, a lock washer and a hex nut. Attach the short aluminum strip to the 12 meter unit in the same way. These strips provide some of the circuit capacitance to resonate the two coils. Remove the upper portion of the antenna above the 30 meter coil. Loosen the #10 hex nuts on the bottom clamp and the wing nut on the upper clamp of the 17 meter assembly, the insulated end up, and slide the assembly over the upper end of the "HF6V" antenna. Slide the unit down until the lower clamp rests on the upper clamp of the 30 meter coil.

Tighten the hex nut and stretch the coil so that the distance between the upper edge of the lower clamp and the lower edge of the upper clamp is as shown to the right. Install the 12 meter unit in the same way, so that the lower edge of the lower clamp is about two inches above the upper clamp of the 17 meter unit. Replace the upper section of the antenna and tighten all hardware.

If mounted at ground level, the antenna should be operated over a number of radial wires, each at least as long as the antenna is tall, in order to reduce the ground loss resistance, and thus, the feedpoint impedance to an acceptably low value. In above-ground installations, at least two resonant radials at 180° should be used per band. The length of a quarter-wave radial for 17 meters is 13 feet 4 inches, and 9 feet 3 inches for 12 meters.

Feed a few watts of power to the antenna on 17 meters and note the frequency at which the SWR is lowest. Normal bandwidth is from 150 to 175 kHz for SWR of 2:1 or less. To move the SWR curve to a higher frequency range loosen the wing nut on the upper coil clamp and stretch the coil about ¼" at a time. To move the SWR curve to a lower frequency range, compress the coil a like amount at a time.

Similarly, apply a few watts of power to the antenna on 12 meters where SWR bandwidth should be greater than 200 kHz. Stretch the 12 meter coil in increments of ¼" or so to raise the tuning range or compress the coil a like amount to lower the tuning range.

For very small upward frequency changes on both 17 and 12 meters, the capacitive loading strip at the upper end of each coil may be bent a few degrees off a straight line. This is equivalent to stretching the coil. In general, however, it will be easier to stretch or compress the coils rather than adjust the loading capacitance.

SWR on both 17 and 12 meters should be less than 2:1 at resonance, though the exact SWR at resonance on any band will depend on the quality of the antenna's ground system. If SWR is not sufficiently below 2:1 on 17 meters, connect the short length of coaxial line provided across the antenna feedpoint. This may improve the match on 17 meters at the cost of a slightly higher SWR at resonance on 15 meters.

Various modifications can be made to the present invention without departing from the apparent scope hereof.

I claim:

1. In combination, a vertical antenna and at least one adapter assembly comprising:

a. vertical antenna resonating on six predetermined segments of the high frequency spectrum comprising first inductor-capacitor means vertically supported and comprising an eighty/seventy-five meter section including an eighty/seventy-five meter inductor and capacitor connected in parallel across the top of said section, said inductor adjusting the center frequency of operation, second inductor-capacitor means vertically connected to said first inductor-capacitor means and comprising a forty-meter section including a forty-meter inductor and capacitor connected in parallel across the top of said section, said inductor adjusting the center frequency of operation, and said inductors and capacitors connecting at a common point on an insulator between said sections, vertical radiating means connected to said second inductor-capacitor means by an insulator post, said vertical radiating means comprising first, second, third, fourth, fifth and sixth vertical radiating sectional elements secured to each of the other respective elements, third inductor-capacitor means vertically supported and comprising a thirty-meter inductor and capacitor connected in series between said forty-meter inductor and said vertical radiating element, stub means connected to a top portion of said vertical radiating means, spaced a fraction of a wavelength therefrom and extending parallel downwardly therefrom, said stub means substantially one-quarter wavelength of fifteen meters, an impedance matching coil connected across said first inductor-capacitor means and ground, a coaxial cable transmission line impedance matching section connected across said impedance matching coil, and said vertical antenna having a height in the range of twenty-five to twenty-six feet whereby a coaxial cable transmission line connected to said first inductor-capacitor means and ground, and the entire vertical radiating length of said vertical antenna is active on five of said six high-frequency spectrum segments and said stub means decouples said vertical radiating means above said stub means thereby yielding a quarter wave vertical radiating means on the frequency corresponding to the length of said stub means; and, b. antenna adapter for adding onto said vertical antenna for operation on a predetermined frequency comprising an air wound coil of a plurality of turns for surrounding an element of said antenna, a clamp at one end for clamping onto said antenna including a nut and bolt assembly, an insulator at another end of the air wound coil secured thereto with a nut and bolt assembly, a clamp at the other end of the insulator for securing to said antenna, and at least one metal capacitor strip extending at a substantially right angle to said air wound coil secured to the junction of said insulator and said end of said air wound coil with a nut and bolt assembly.

2. In combination, vertical antenna and two adapter assemblies comprising:

a. vertical antenna for operation on the eighty/seventy-five, forty-, thirty-, twenty-, fifteen- and ten-meter high-frequency segments of the high-frequency spectrum comprising tubular support post including a solid fiberglass insulator extending therefrom and secured to said support post with a nut-and-bolt assembly, eighty-meter inductor-capacitor section including an eighty-meter inductor supported at the top of said eighty-meter section and a capacitor connected in parallel across said inductor and vertically supported on said insulator, forty-meter inductor capacitor section including a forty-meter inductor supported at the top of said forty-meter section and a capacitor connected in parallel across said forty-meter inductor section and vertically affixed to said eighty-meter resonator capacitor section, first, second, third, fourth, fifth and sixth vertical section radiating elements, said first element vertically affixed to the top of an insulator telescoped into said forty-meter section with a self-tapping sheetmetal screw, said second element telescoped into said first element and secured thereto with a self-tapping sheetmetal screw, and third element telescoped into said second element and secured thereto with a self-tapping sheetmetal screw, said fourth element telescoped into said third element and secured thereto with a self-tapping sheetmetal screw, said fifth element telescoped into a top portion of said fourth element and secured thereto with a self-tapping sheetmetal screw, and said sixth element telescoped into a slotted top portion of said fifth element and secured thereto with a hose clamp, thirty-meter capacitor section vertically supported and including a thirty-meter inductor-capacitor connected in series between a tap on said forty-meter inductor and a lower portion of said vertical radiating elements, fifteen-meter quarter wave stub section including insulators positioned over and extending outwardly from said second and third elements, a braid and a bracket including nut-and-bolt assemblies affixing a top of said braid to said fifth element, said braid one-quarter wavelength of fifteen meters in length, whereby said eighty-meter inductor adjusts the center frequency of operation on eighty meters, said forty-meter inductor adjusts the center frequency of operation on forty meters, said thirty-meter inductor adjusts said center frequency of thirty meters, the center frequency of operation on twenty meters is adjusted by telescoping said radiating elements into each other, the center frequency of operation on fifteen meters adjusted by the length of said braid, and the center frequency of operation on ten meters is adjusted by telescoping said radiating elements into each other for low voltage standing wave ratio on each of the center frequencies; and, b. adapter assemblies for 12 meters and 17 meters for said vertical antenna for operation on predetermined frequencies comprising air wound coils of a plurality of turns for surrounding a section of said antenna, clamps at one end for clamping onto said antenna including a nut and bolt assembly, insulators at another end of the coils secured thereto with a nut and bolt assembly, clamps at the other end of the insulators for securing to said section of said antenna, and two metal capacitor strips each extending at a substantially right angle to respective coils secured to the junction of each insulator and said end of each coil with a nut and bolt assembly, said adapter assemblies mounted on said vertical antenna above said thirty meter section.

* * * * *